US006027140A

United States Patent [19]

Plutsky

[11] Patent Number: 6,027,140

[45] Date of Patent: Feb. 22, 2000

[54] PHOTOGRAPH ALBUM PAGE INSERT

[76] Inventor: Sheldon Plutsky, 9801 Deering Ave., Chatsworth, Calif. 91311

[21] Appl. No.: 08/910,946

[22] Filed: Aug. 14, 1997

[51] Int. Cl.[7] ..... B42D 1/00

[52] U.S. Cl. ..... 281/38; 281/22; 402/79

[58] Field of Search ..... 281/38, 22; 402/79

[56] References Cited

U.S. PATENT DOCUMENTS

| | | | |
|---|---|---|---|
| 937,767 | 10/1909 | Mentzer . | |
| 1,797,900 | 3/1931 | Cravitz . | |
| 2,193,296 | 3/1940 | Pienzak | 40/159 |
| 2,925,677 | 2/1960 | Holes | 40/159 |
| 3,797,146 | 3/1974 | Holes | 40/104.18 |
| 3,831,301 | 8/1974 | Reynard | 40/104.18 |
| 4,447,973 | 5/1984 | Wihke | 40/159 |
| 5,040,216 | 8/1991 | Policht | 281/22 |
| 5,183,296 | 2/1993 | Policht | 281/22 |
| 5,186,566 | 2/1993 | Cameron | 402/79 |
| 5,237,355 | 8/1993 | Kiehne et al. | 353/120 |
| 5,316,404 | 5/1994 | Hensel | 402/79 |
| 5,335,027 | 8/1994 | Lin et al. | 402/79 |
| 5,393,158 | 2/1995 | Dall' Arancio | 402/79 |
| 5,823,573 | 10/1998 | Chang | 281/22 |
| 5,848,851 | 12/1998 | Gunasekera | 281/22 |

*Primary Examiner*—Andrea L. Pitts
*Assistant Examiner*—Monica Smith
*Attorney, Agent, or Firm*—Jeffer, Mangels, Butler & Marmaro LLP

[57] ABSTRACT

In accordance with one aspect of the present invention there is provided a page insert having a first transparent sheet, a second transparent sheet and a non-transparent sheet sandwiched between the first and second transparent sheets. At least one of the transparent sheets has an edge, and adjacent the edge at least one of the transparent sheets has at least two different shaped openings therethrough.

19 Claims, 6 Drawing Sheets

FIG. 1
PRIOR ART
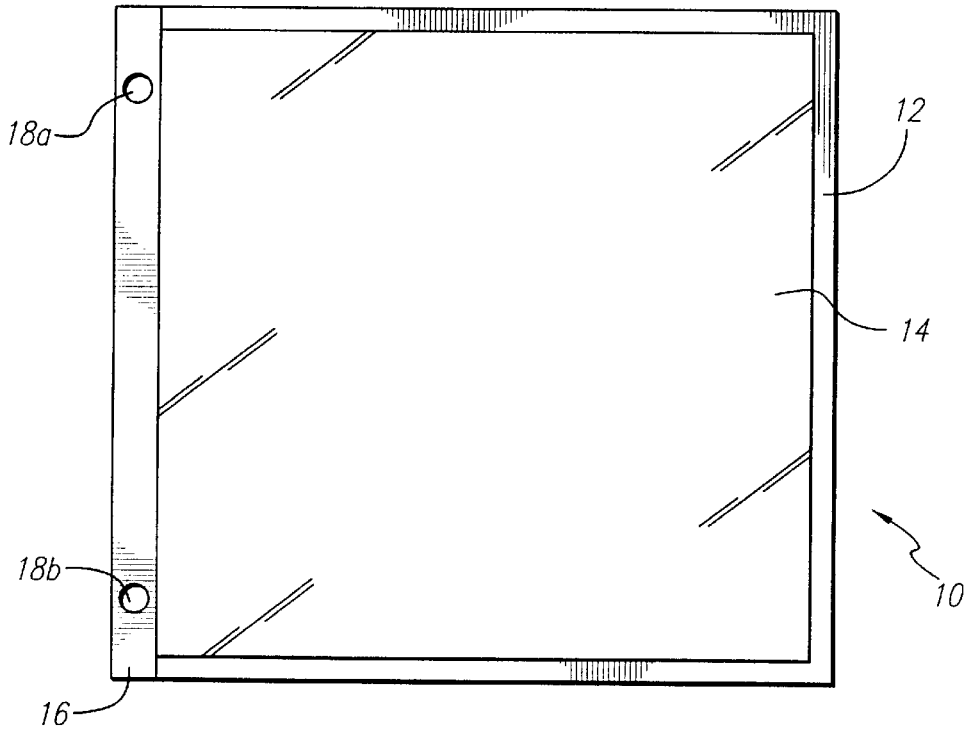
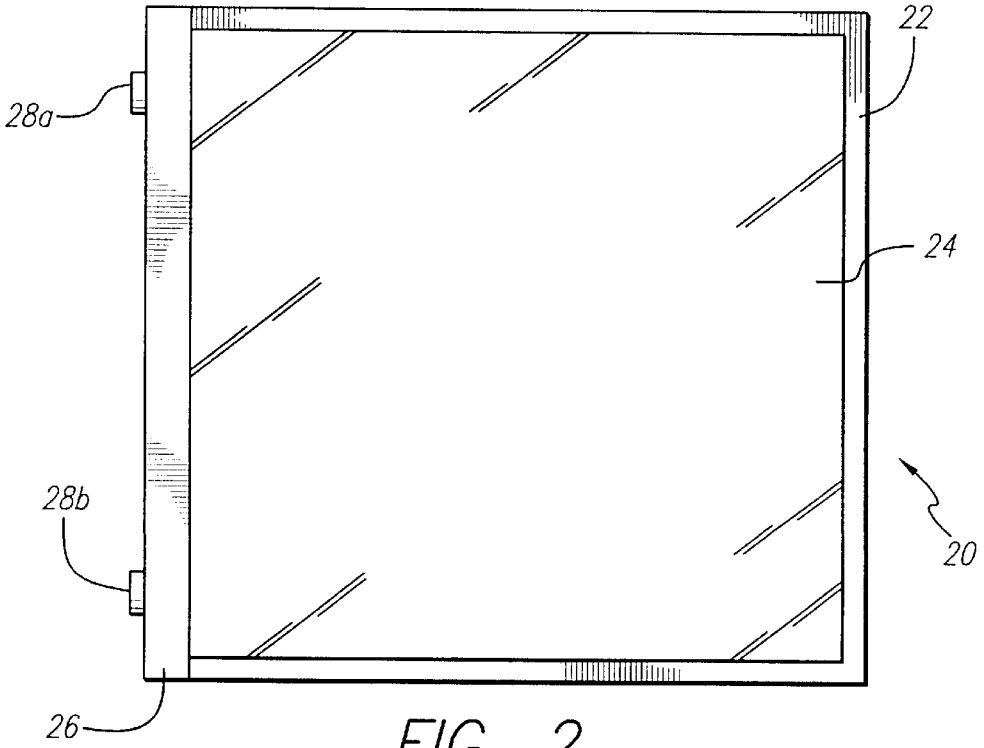
FIG. 2
PRIOR ART

FIG. 3
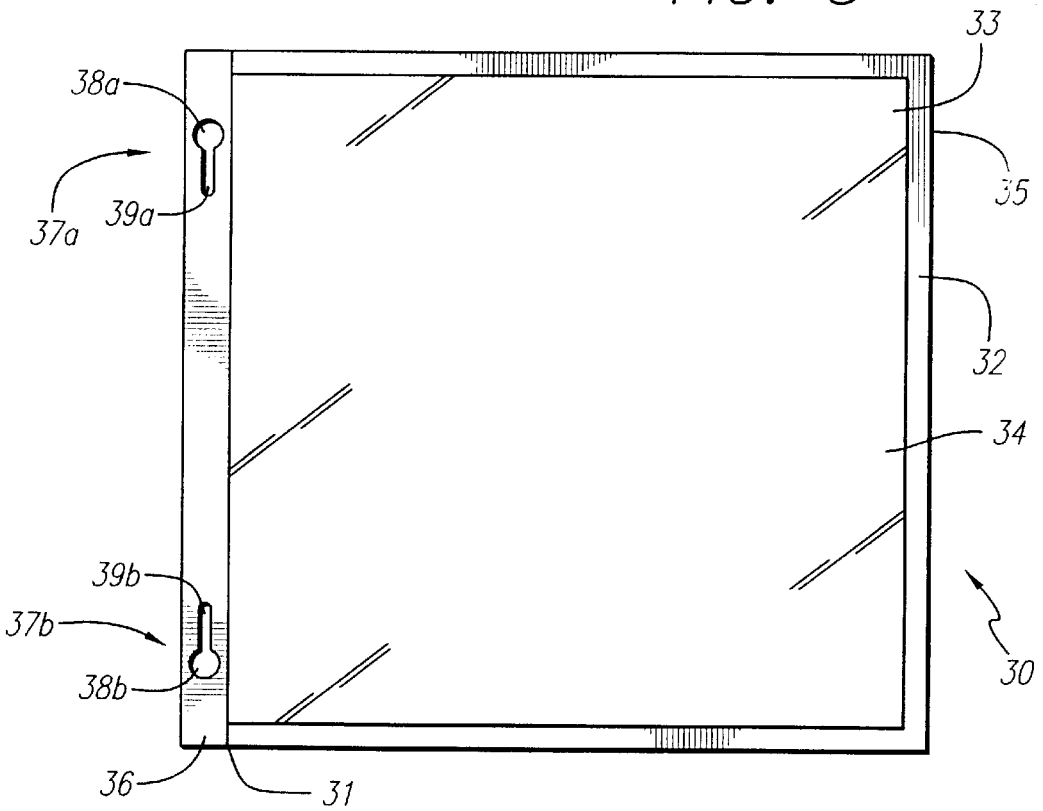
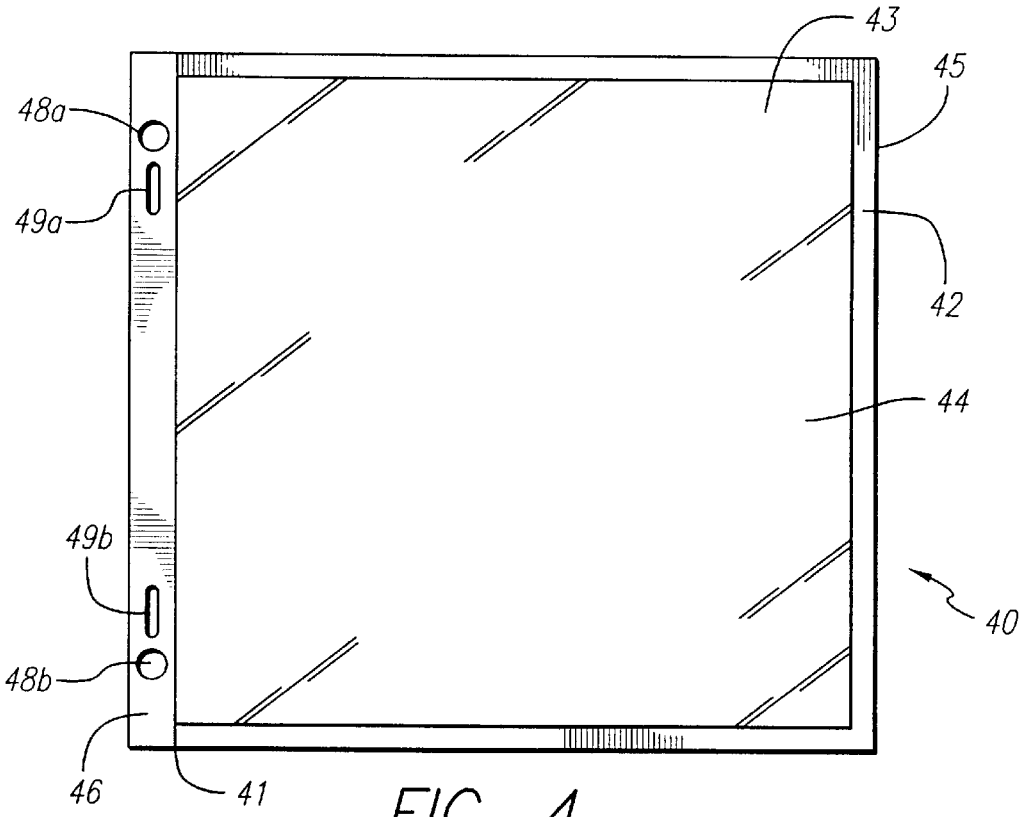
FIG. 4

PHOTOGRAPH ALBUM PAGE INSERT

FIELD OF THE INVENTION

The present invention relates to apparatus and methods for the storage of, photographs on photograph page album inserts within a photograph album.

BACKGROUND OF THE INVENTION

Photograph albums use a number of different types of page inserts. The page inserts retain the photographs and in turn the page inserts are retained by the binder of the photograph album. Photograph albums can use two types of mechanisms for retaining page inserts therein. One mechanism uses either posts, generally round posts, or openable and closeable rings to retain the photograph album page insert. Another mechanism uses a ribbon or a strap to retain the photograph album page insert. Heretofore, photograph album page inserts which are suitable for use with a photograph album using one of the above-described mechanisms are not suitable for use with a photograph album using the other above-described mechanism. Therefore, photograph album page inserts must be separately manufactured to fit the different types of photograph albums available. This requires that inventory be kept with respect to two separate items and that appropriate amounts of each type of insert, which may not be in equal demand, be produced, ordered and stocked by manufacturers and sellers of photograph album page inserts. Also, those photograph album page inserts which are manufactured to be used with the ribbon-retaining type photograph albums generally require the use of metal retaining clips which the ribbons are threaded through. The clips are held in place by a separate binder, generally of paper or cardboard which must be affixed to the rest of the page insert, which requires additional manufacturing materials and steps.

Accordingly, it would be desirable to provide a photograph album page insert that can be easily manufactured and that can be securely retained in a photograph album using either of the above-described mechanisms of retaining page inserts.

SUMMARY OF THE INVENTION

In accordance with one aspect of the present invention there is provided a page insert having a first transparent sheet, a second transparent sheet and a non-transparent sheet sandwiched between the first and second transparent sheets. At least one of the transparent sheets has an edge, and adjacent the edge at least one of the transparent sheets has at least two different shaped openings therethrough.

In accordance with another aspect of the present invention there is provided a page insert having an edge, the edge having disposed adjacent thereto at least two keyhole shaped holes therethrough.

In accordance with yet another aspect of the present invention there is provided a photograph album page insert securable in a first photograph album, and securable in a second photograph album. The first album includes at least one first securing element, and the second album including at least one second securing element different than the first securing element. The page insert includes at least a first sheet having a top edge, a bottom edge, a left edge and a right edge. The page insert also includes a pocket for retaining a photograph therein. The first sheet also has at least one first standardly shaped hole defined therethrough and further has at least one second standardly shaped ribbon slot defined therethrough. The at least one first securing element can securely register with the at least one first standardly shaped hole and the at least one second securing element can securely register with the at least one second standardly shaped ribbon slot.

In accordance with another aspect of the present invention there is provided a photograph album containing a page insert as described above.

Other features and advantages of the invention will become apparent from the following detailed description, taken in conjunction with the accompanying drawings which illustrate, by way of example, various features of preferred embodiments of the invention.

DESCRIPTION OF THE FIGURES

The detailed description of the invention will be made with reference to the accompanying drawings, where like numerals designate corresponding parts of the figures. The drawings are meant to be generally illustrative of various examples of the present invention, but are merely examples and are not meant to be limiting of the scope of the invention.

FIG. 1 depicts a prior art photograph album page insert which is suitable for use in a photograph album which uses rings or posts as a securing element.

FIG. 2 depicts a prior art photograph album page insert which is suitable for use in a photograph album which uses a ribbon or strap as a securing element.

FIG. 3 depicts one embodiment of a photograph album page insert of the present invention which is suitable for use in a photograph album which uses rings or posts or a ribbon or a strap as a securing element.

FIG. 4 depicts another embodiment of a photograph album page insert of the present invention which is suitable for use in a photograph album which uses rings or posts or a ribbon or a strap as a securing element.

DETAILED DESCRIPTION OF THE INVENTION

Figure 5:
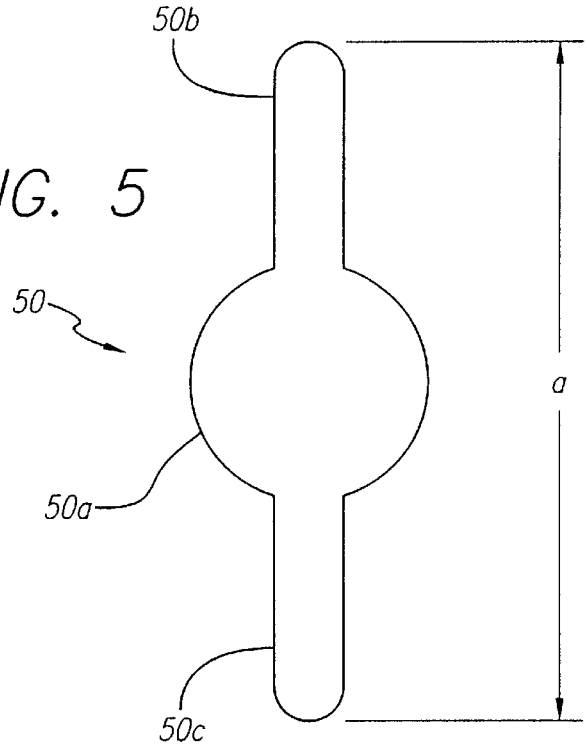
FIG. 5 depicts an embodiment of an opening suitable for use with a page insert of the present invention.

FIG. 1 depicts a prior art photograph album page insert 10 which includes a pocket 12 and a pocket insert 14. A left tab portion 16 includes two holes 18*a* and 18*b* which can be used with photograph albums which use either a post or a ring to engage holes 18*a* and 18*b* and thereby retain photograph album page inserts therein.

FIG. 2 depicts a prior art photograph album page insert 20 which includes a pocket 22 and a pocket insert 24. A left tab portion 26 includes two retaining clips 28*a* and 28*b* which can be used with photograph albums which use either a ribbon or a strap to engage retaining clips 28*a* and 28*b* and thereby retain photograph album page inserts therein.

FIG. 3 depicts one embodiment of a photograph album page insert 30, of the present invention, which includes a pocket 32 and a pocket insert 34. Pocket 32 is formed from first sheet 33 and second sheet 35. A left tab portion 36 includes a first opening 37*a* having hole portion 38*a* and slot portion 39*a* and a second opening 37*b* having hole portion 38*b* and slot portion 39*b*. First and second openings 37*a* and 37*b* can engage a securing element in photograph albums which use either a post or a ring, the ring or post engaging hole portions 37*a* and 37*b*, or can engage a securing element in photograph albums which use either a ribbon or a strap, the ribbon or strap engaging slot portions 39*a* and 39*b*. The ribbon or strap can either fit entirely within slot portions 39*a* and 39*b* or can overhang into hole portions 38*a* and 38*b*.

FIG. 4 depicts another embodiment of a photograph album page insert 40, of the present invention, which includes a pocket 42 and a pocket insert 44. Pocket 42 is formed from first sheet 43 and second sheet 45. A left tab portion 46 includes first openings, holes 48*a* and 48*b*, and second openings, slots 49*a* and 49*b*. In this particular embodiment, holes 48*a* and 48*b* are not continuous with slots 49*a* and 49*b*. It is to be understood that slots 49*a* and 49*b* can be positioned to the left of, to the right of, above or, as depicted, below holes 48*a* and 48*b*.

The pockets 32 and 42 of photograph album page inserts 30 and 40 can be formed of various materials which are preferably transparent, but which may be colored or translucent. Such materials include but are not limited to hard plastic, soft plastic, thermoplastic, acetate sheets, and the like. In alternative embodiments, a pocket can be formed from other than two sheets such as first sheets 33 or 43, and second sheets 35 or 45. For example, a first sheet 33 or 43 can be used alone and a pocket can be formed on the sheet which will retain a photograph thereon. The pocket can be formed from slots in the sheets which the corners of photographs can be fit into to be retained therein. In another embodiment, retaining means, such as adhesive corners can be used as pockets to retain photographs on first sheet 33 or 43.

In a particular embodiment, sheets 33 and 35 or 43 and 45 can be sealed together to provide a number of pockets which will fit various standard sized photographs such as 3 inches by 5 inches, 4 inches by 6 inches and other sizes as are known in the art.

In another particular embodiment, sheets 33 and 35 and 43 and 45 can be attached to each other along a portion of each sheet intermediate between an edge of each sheet and the center of each sheet, for example, along seam 31 and 41 respectively.

Particular embodiments of the present invention can use pocket inserts 34 and 44, however, in some embodiments, for example, those in which sheets 33 and 35 or 43 and 45 form pockets, pocket inserts need not be used. Pocket inserts can be made from materials including but not limited to paper, cardboard, plastic and the like. Photographs can be placed on pocket inserts 34 and 44, which in one embodiment, can contain an adhesive or can adhere to the material forming pockets 32 and 42, thereby retaining the photographs placed thereon. Alternatively, pocket inserts 34 and 44 can contain slots which the corners of photographs can be fit into to retain them. In another embodiment, pocket inserts 34 and 44 can be plain sheets, and adhesives or adhesive tape or photograph retaining means, such as adhesive corners can be used to retain photographs thereon.

Holes 38*a*, 38; 48*a* and 48*b*; 50, 68*a* and 68*b*; 72*a* and 72*b*; 74*a* and 74*b*; 76*a* and 76*b* and 71*a*, 75 and 79 are depicted as circular, however, other shapes such as squares, triangles, other polygons and combinations thereof are within the scope of the present invention. The size of the holes as set forth above can also vary. Preferably, the holes are of a size which will securely engage a post or ring. In a particular embodiment, the holes are about a quarter of an inch in diameter. Two holes are depicted, however, a single hole or three or more holes are within the scope of the present invention. The holes are preferably disposed on the left side of page inserts 30 and 40. However, the holes can be disposed on the top, bottom or right side of page inserts 30 and 40. In a preferred embodiment, the hole is a standardly shaped hole which will securely engage standard shaped and sized posts or rings and similar securing elements standardly used in photograph albums to secure page inserts thereto.

The width of slots 39*a*, 39*b*; 49*a*, 49*b*; 50*b*, 50*c*; 70*a*, 70*b*; 74*a*, 74*b*; and slots 78*a*, 78*b* can vary depending upon the thickness of ribbon or strap they may be used with. Preferably, the above-referenced slots snugly engage a ribbon or strap inserted therein. In a preferred embodiment, the slot is a standardly shaped ribbon slot which will securely engage standard shaped and sized ribbons and straps and similar securing elements standardly used in photograph albums to secure page inserts thereto. In a particular embodiment, the slots are about one sixteenths of an inch in width. Any combination of holes and slots described above which are different from each other comprise at least two different shaped openings. Preferably, as shown in FIGS. 3–6*c*, the width of the holes 38*a*, 38; 48*a* and 48*b*; 50, 68*a* and 68*b*; 72*a* and 72*b*; 74*a* and 74*b*; 76*a* and 76*b* and 71*a*, 75 and 79 is wider than the width of the slots 39*a*, 39*b*; 49*a*, 49*b*; 50*b*, 50*c*; 70*a*, 70*b*; 74*a*, 74*b*; and 78*a*, 78*b*.

FIG. 5 depicts an opening 50*a* which includes slots 50*b* and 50*c*. Opening 50*a* can be disposed at any point along line a. At one extreme, when opening 50*a* is at the top of line a only slot 50*c* remains, when opening 50*a* is at the bottom of line a only slot 50*b* remains. When opening 50*a* is exactly intermediate on line a, slot 50*b* and 50*c* are equal, as 50*a* moves along line a slot 50*b* and 50*c* are increased or reduced in size correspondingly. All of these combinations of opening 50*a* and slots 50*b* and 50*c* are defined herein as keyhole shaped holes. Additionally, all combinations of opening 50*a* and slots 50*b* and 50*c* define openings which at least partially overlap thereby defining keyhole shaped holes. That is, a keyhole shaped hole is one wherein an opening overlaps a slot at any point along the longitudinal extent of the slot, wherein the opening has a width wider than that of the slot. In contrast, hole 48*a* and slot 49*a* and hole 49*b* and slot 49*b* depict openings which do not overlap.

Figure 6A:
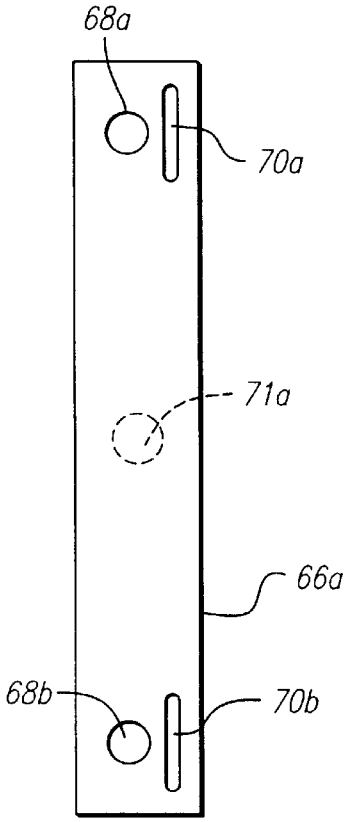
FIG. 6 depicts three different binder sections of a photograph album page insert suitable for use in a photograph album which uses rings or posts as a securing element.
Figure 6B:
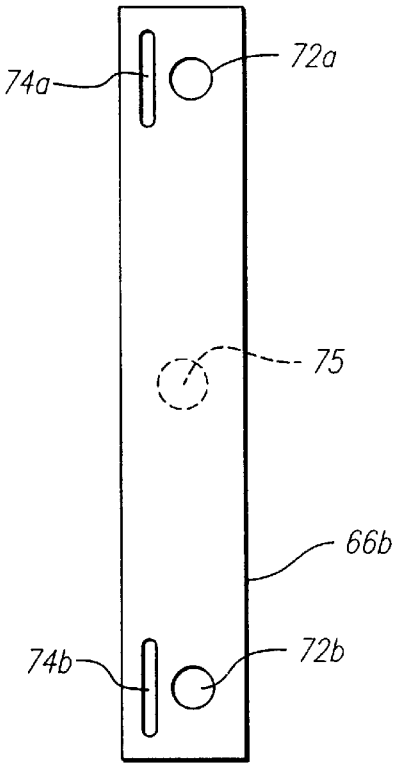
Figure 6C:
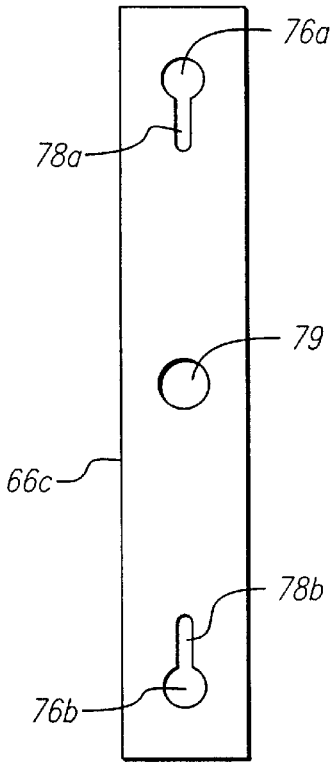

FIG. 6 depicts three variant left tab portions 66*a*, 66*b* and 66*c* illustrating various arrangements of holes including: 68*a* and *b* and 71*a* and slots 70*a* and 70*b*; 72*a* and *b* and 75 and slots 74*a* and 74*b*; and 76*a* and *b* and 79 and slots 78*a* and 78*b*. It is to be understood that these arrangements of holes and slots could be disposed on the right tab, top or bottom portion of a photograph album page insert.

Figure 7:
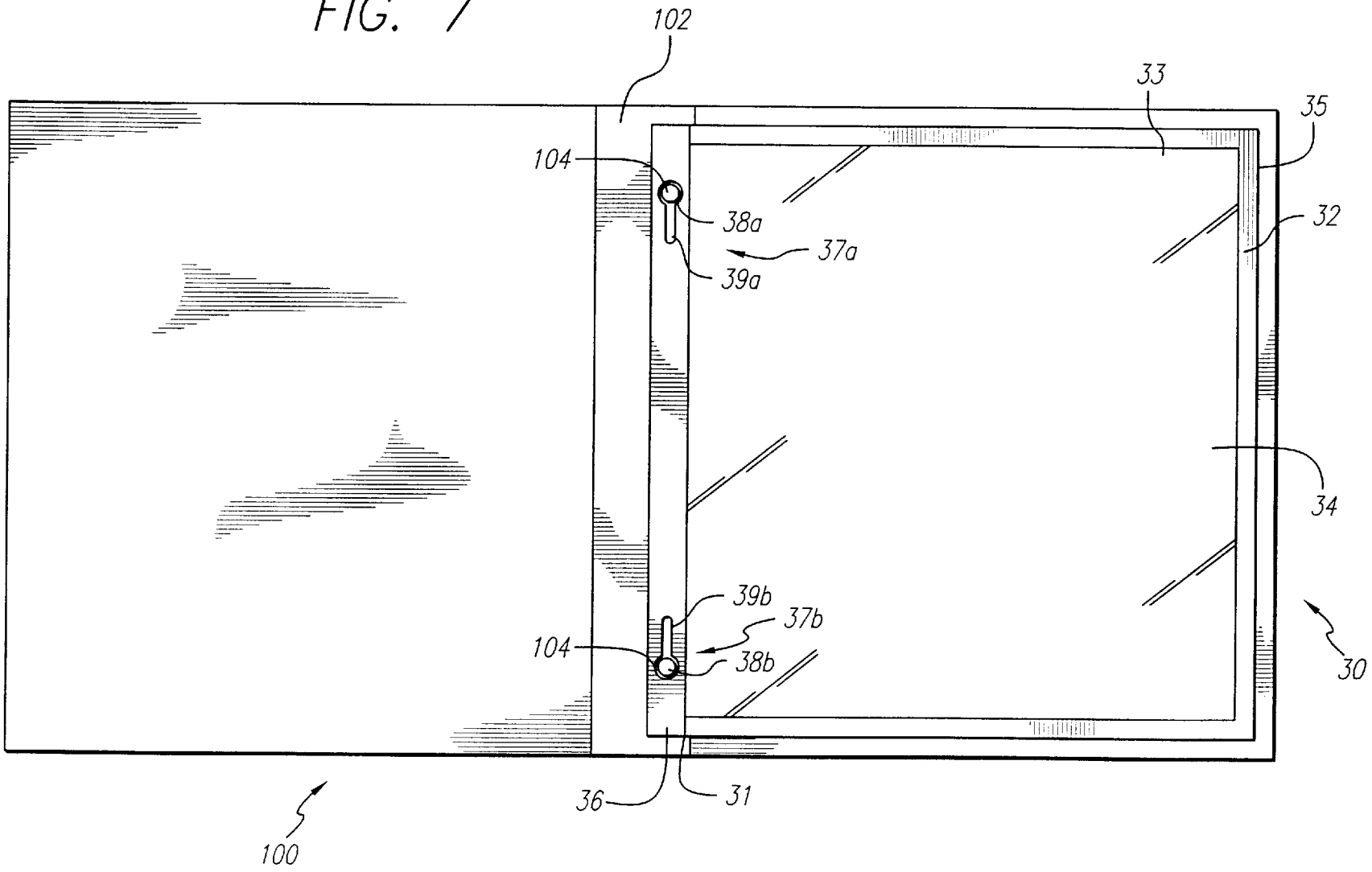
FIG. 7 depicts a photograph album having a plurality of posts as securing elements including the page insert of FIG. 3.
Figure 8:
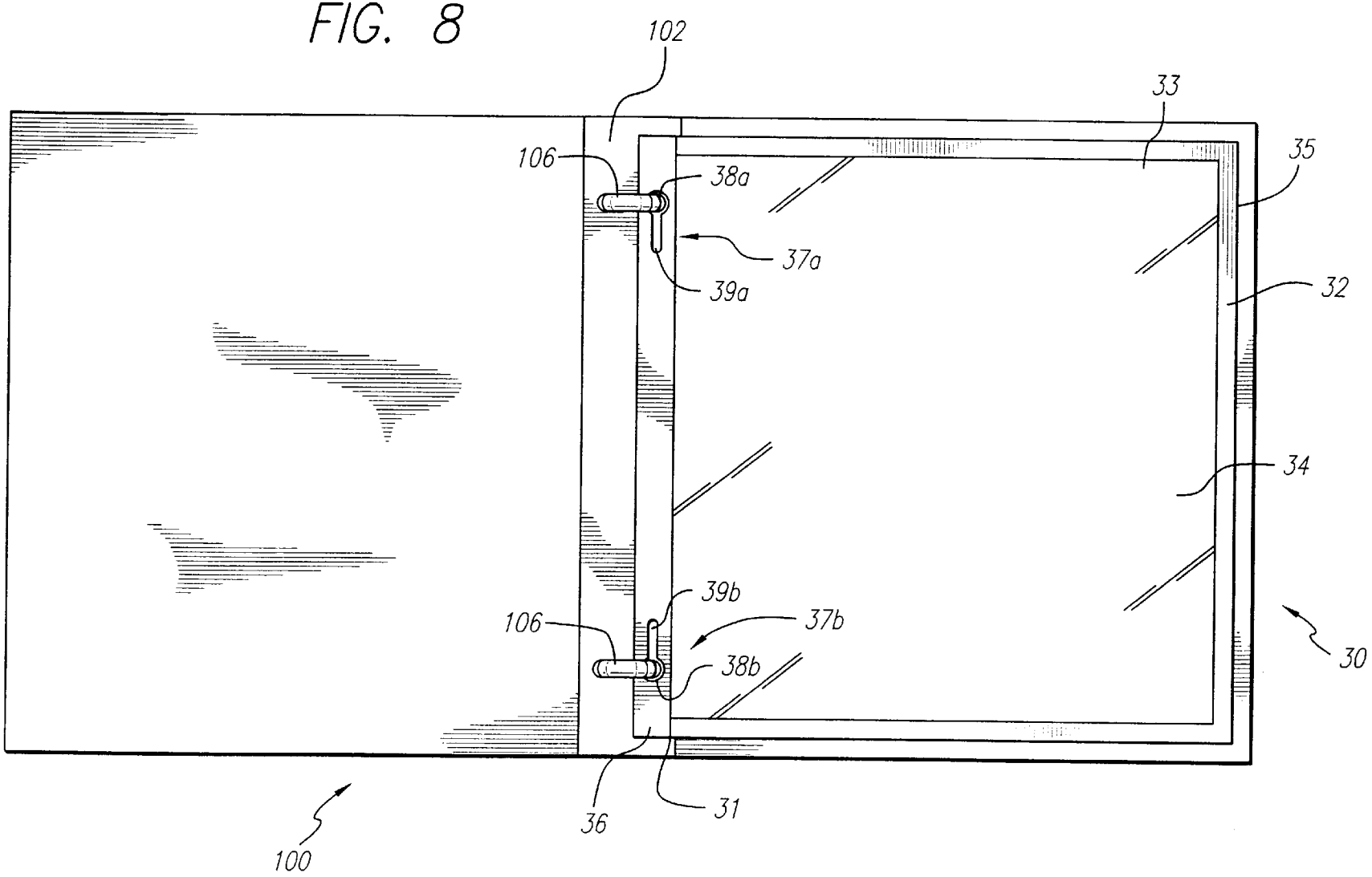
FIG. 8 depicts a photograph album having a plurality of rings as securing elements including the page insert of FIG. 3.
Figure 9:
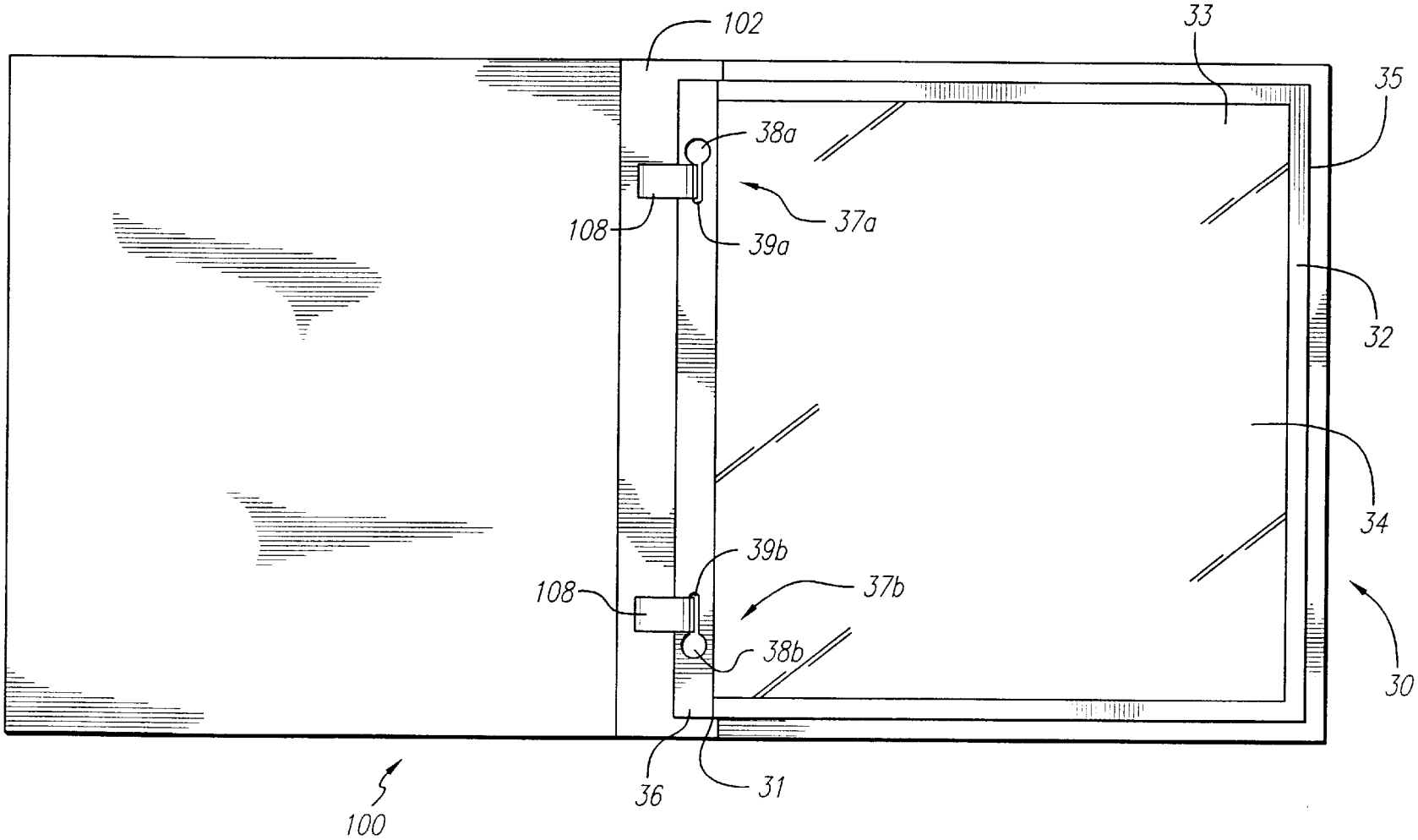
FIG. 9 depicts a photograph album having a plurality of ribbons as securing elements including the page insert of FIG. 3.

FIGS. 7–9 show page insert 30, as described above, disposed in a photograph album 100 including a binder 102 and various page insert securing elements. In FIG. 7 the page insert securing element is a post 104; in FIG. 8 the page insert securing element is a ring 106; and in FIG. 9 the page insert securing element is a ribbon 108. It will be understood that the various page insert securing elements can be employed with the various page inserts 30, 40 and variations thereof described above.

The presently disclosed embodiments are to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A page insert having a first transparent sheet, a second transparent sheet and a non-transparent sheet sandwiched between the first and second transparent sheets, wherein at least one of the transparent sheets has an edge, wherein adjacent the edge at least one of the transparent sheets has at least two different shaped openings therethrough, wherein the at least two different shaped openings are at least one hole and at least one slot each having a width, said width of said at least one hole being wider than said width of said at least one slot, and wherein the two different shaped openings at least partially overlap and have a continuous peripheral edge.

2. The page insert of claim 1 wherein the hole is a circular hole.

3. The page insert of claim 1 wherein the hole is a non-circular hole.

4. The page insert of claim 1 wherein the two different shaped openings do not overlap.

5. A page insert having an edge, the edge having disposed adjacent thereto at least two keyhole shaped holes therethrough, said at least two keyhole shaped holes having a continuous peripheral edge.

6. The page insert of claim 5 comprising a first sheet having a top edge, a bottom edge, a left edge and a right edge and a second sheet having a top edge, a bottom edge, a left edge and a right edge overlying the first sheet.

7. The page insert of claim 6 wherein the first sheet and the second sheet each have a center and are attached to each other along a portion of each sheet intermediate between an edge of each sheet and the center of each sheet.

8. A photograph album page insert securable in a first photograph album, and securable in a second photograph album, the first album including at least one first securing element, and the second album including at least one second securing element different than the first securing element, the page insert comprising:

a) a first sheet having a top edge, a bottom edge, a left edge and a right edge;

b) a pocket for retaining a photograph therein; and c) the first sheet also having at least one hole having a width defined therethrough, and further having at least one slot having a width defined therethrough, wherein the at least one first securing element can securely register with the at least one hole and the at least one second securing element can securely register with the at least one slot, wherein the width of the at least one hole is wider than the width of the at least one slot, and wherein the hole and the slot at least partially overlap and have a continuous peripheral edge.

9. The photograph album page insert of claim 8 wherein the pocket for retaining a photograph therein comprises the first sheet having a top edge, a bottom edge, a left edge and a right edge and a second sheet having a top edge, a bottom edge, a left edge and a right edge overlying the first sheet.

10. The photograph album page insert of claim 8 wherein the hole and the slot are positioned adjacent the left edge of the first sheet.

11. The photograph album page insert of claim 8 wherein the hole and the slot do not overlap.

12. The photograph album page insert of claim 9 wherein the first sheet and the second sheet are continuous with each other along three of the four edges.

13. The photograph album page insert of claim 9 further comprising a third sheet disposed between the first sheet and the second sheet.

14. A photograph album comprising a binder including a page insert securing element and further including the page insert of claim 1.

15. The photograph album of claim 14 wherein the page insert securing element comprises at least one post.

16. The photograph album of claim 14 wherein the page insert securing element comprises at least one ring.

17. The photograph album of claim 14 wherein the page insert securing element comprises at least one ribbon.

18. A photograph album comprising a binder including a page insert securing element and further including the page insert of claim 5.

19. A photograph album comprising a binder including a page insert securing element and further including the page insert of claim 8.

* * * * *